US007586473B2

(12) United States Patent
Edwards et al.

(10) Patent No.: US 7,586,473 B2
(45) Date of Patent: Sep. 8, 2009

(54) ACTIVE MATRIX ARRAY DEVICE, ELECTRONIC DEVICE AND OPERATING METHOD FOR AN ACTIVE MATRIX ARRAY DEVICE

(75) Inventors: Martin J. Edwards, Crawley (GB); John R. A. Ayres, Reigate (GB)

(73) Assignee: TPO Hong Kong Holding Limited, Shatin, Hong Kong Sar (HK)

( * ) Notice: Subject to any disclaimer, the term of this patent is extended or adjusted under 35 U.S.C. 154(b) by 642 days.

(21) Appl. No.: 10/552,411

(22) PCT Filed: Mar. 30, 2004

(86) PCT No.: PCT/IB2004/001047

§ 371 (c)(1),
(2), (4) Date: Oct. 6, 2005

(87) PCT Pub. No.: WO2004/090854

PCT Pub. Date: Oct. 21, 2004

(65) Prior Publication Data

US 2007/0040785 A1 Feb. 22, 2007

(30) Foreign Application Priority Data

Apr. 9, 2003 (GB) ..... 0308167.6

(51) Int. Cl.
*G09G 3/36* (2006.01)

(52) U.S. Cl. ..... 345/92; 345/84; 345/87; 345/90; 345/204; 345/206

(58) Field of Classification Search ..... 345/55, 345/76, 77, 80, 82, 84, 87, 90, 92, 204, 205, 345/206, 211, 212, 213, 214, 690
See application file for complete search history.

(56) References Cited

U.S. PATENT DOCUMENTS

| | | | | |
|---|---|---|---|---|
| 6,278,426 | B1 * | 8/2001 | Akiyama | 345/87 |
| 6,864,883 | B2 * | 3/2005 | Hector et al. | 345/204 |
| 7,221,343 | B2 * | 5/2007 | Kageyama et al. | 345/82 |
| 2003/0016202 | A1 | 1/2003 | Ayres et al. | |

* cited by examiner

*Primary Examiner*—My-Chau T Tran
(74) *Attorney, Agent, or Firm*—Liu & Liu

(57) ABSTRACT

An active matrix array device has a plurality of matrix array elements (100), each of which have a first capacitive device (120) coupled to a charging conductor (32*m*) via a first switch (100) being responsive to an addressing conductor (22*n*). In addition, the matrix array elements (100) comprise a second capacitive device (130) coupled to the first capacitive device (120) via a second switch (112) being responsive to en enable signal provided via an enable conductor (42*n*). The second capacitive device (130) is coupled to the control terminal of a third switch (114), which is coupled between the first capacitive device (120) and a potential source like the charging conductor (32*m*). The second capacitive device (130) is used to sample the voltage across the first capacitive device (120), which enables the third switch (114) if of an appropriate value, thus providing a conductive path between the first capacitive device (120) and the potential source. This arrangement allows for a low-power data refresh mode of the matrix array elements (100) with polarity inversion in subsequent refresh cycles.

11 Claims, 9 Drawing Sheets

Figure 1:
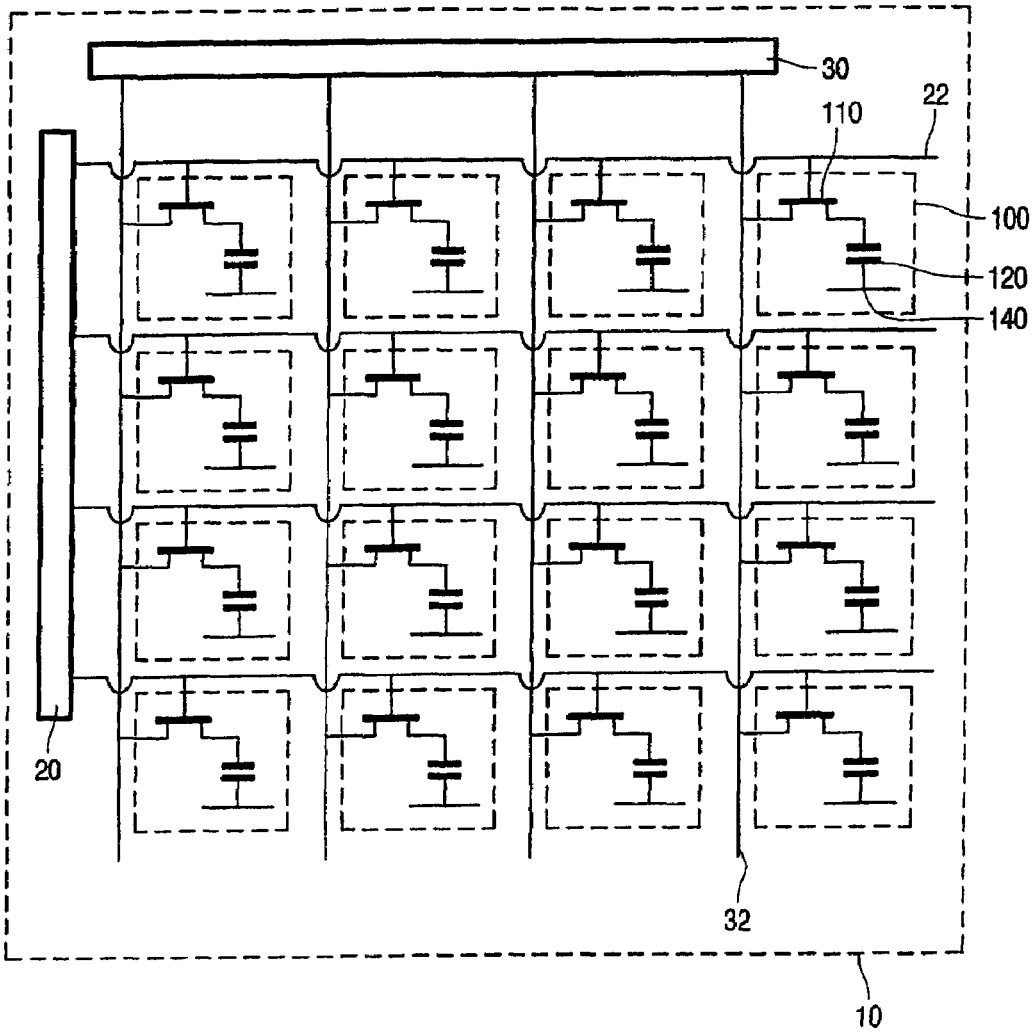
FIG.1 (PRIOR ART)

ACTIVE MATRIX ARRAY DEVICE, ELECTRONIC DEVICE AND OPERATING METHOD FOR AN ACTIVE MATRIX ARRAY DEVICE

The present invention relates to active matrix devices comprising a plurality of charging conductors, a plurality of addressing conductors crossing the plurality of charging conductors and a plurality of matrix array elements, each matrix array element being coupled to an associated addressing conductor and an associated charging conductor via a first switch, and having a first capacitive device.

The present invention also relates to an electronic device comprising such an active matrix device.

The present invention further relates to a method for operating such an active matrix array device.

Active matrix array devices have found widespread use in a wide variety of application domains, in which they have been used as sensors or memories, and particularly for display purposes, for instance active matrix array liquid crystal (LC) display devices, or active matrix array organic light emitting diode (OLED) devices. Especially the LC-type display devices are competing with the more traditional cathode ray tube (CRT) display devices as the leading technology in many display device areas.

An active matrix array device typically includes a plurality of charging conductors, which are arranged to cross a plurality of addressing conductors, as well as a plurality of matrix array elements, with a matrix array element being connected to both an addressing conductor and a charging conductor at the intercrossing of these two conductors via a switch like a thin film transistor (TFT). The charging conductors are arranged to store a plurality of charges in the capacitive devices of the respective matrix array elements that have been enabled by one of the addressing conductors. In the case of an active matrix array display device, the addressing conductors typically are the row conductors and the charging conductors typically are the column conductors, with the matrix array elements being the pixels of the display device. The pixels may include capacitive devices like an LC cell in the case of an LC display device and a capacitor to assist the display element to maintain its state between successive charge cycles.

Active matrix array devices, and in particular active matrix array display devices have found widespread use in battery powered electronic devices like lap-top computers, mobile phones, personal digital assistants and so on. In such devices, reduction of power consumption is an important issue, because it has a direct impact on the contiguous operational time of the electronic device. Therefore, the ability to reduce the power consumption of the active matrix array device is important, because it can contribute to the overall power reduction of the electronic device.

A significant part of the power consumption of an active matrix array device originates from the charging of the matrix array elements. Especially in large area active matrix array devices or in active matrix array devices having a large number of addressing and charging conductors, each of the conductors has a relatively large capacitance, and charging the matrix array elements can consume significant amounts of power, because the charging conductors capacitances may have to be charged and discharged numerous times to sequentially store the appropriate charges in all the associated matrix array elements in one addressing cycle of the active matrix array device.

This is particularly wasteful in situations where the data values stored in the respective matrix array elements do not change and are periodically overwritten with the same data values. This can for instance occur in situations where the active matrix array device is required to produce a constant output over a prolonged period of time, for instance because the electronic device of which the active matrix array device forms a part of, is switched to a standby state.

The PCT patent application WO 03/007286 discloses an active matrix array LC display device having an arrangement for reducing the power consumption of the active matrix array LC display device. To this end, the matrix array elements include a refresh circuit including an inverter coupled to the pixel capacitance via a pair of TFTs. Periodically, the data stored on the pixel capacitance is transferred to the input capacitance of the inverter, after which the second TFT is enabled to drive the inverted value of the stored data back to the pixel capacitance. An inverter is required to invert the data signal stored in the matrix array elements in order to prevent the deterioration of the LC material. By means of this arrangement, the signals stored in the matrix array element can be periodically updated without having to employ charge cycles involving the charging and discharging of the relatively large charging conductor capacitances, thus reducing the power consumption in situations where the state of the matrix array elements does not change.

However, this arrangement has the drawback that inverters have to be used as elements to temporarily store the state of the pixel capacitance. This is relatively cumbersome, because the inverter transistors have to be respectively coupled to separate source and drain voltage sources, and typically need to be of an opposite channel type, which increases the cost and complexity of the active matrix array device design.

It is an object of the present invention to provide an active matrix array device according to the opening paragraph that does not require the use of inverters to implement refresh functionality in the matrix array elements.

It is another object of the present invention to provide an electronic device according to the opening paragraph that benefits from having such an active matrix array device.

It is yet another object of the present invention to provide a method of operating such an active matrix array device.

Now, according to a first aspect of the present invention, there is provided an active matrix array device comprising a plurality of charging conductors, a plurality of addressing conductors crossing the plurality of charging conductors, and a plurality of matrix array elements, each matrix array element comprising a first switch having a control terminal coupled to an associated addressing conductor and a data terminal coupled to an associated charging conductor, each matrix array element further comprising a first capacitive device coupled to a further data terminal of the first switch, a second capacitive device coupled to the first capacitive device via a second switch having a control terminal responsive to an enable signal, the second capacitive device having a smaller capacitance than the first capacitive device and a third switch coupled between the first capacitive device and a potential source, the third switch having a control terminal coupled to the second capacitive device.

Rather than using an inverter as a memory element, the active matrix array device of the present invention uses a non-inverting second capacitive device such as a small capacitor for storing the state of the first capacitive device, which may be capacitor for storing a data value in the matrix array element. After the state of the first capacitive device is memorized in the second capacitive device, the first capacitive device can be repeatedly overwritten with a fixed value, like a binary high or a binary low, regardless of what the value stored in the matrix array element should be. The fixed voltage may be applied by the associated charging conductor, which has the advantage that the charging conductor provides the same voltage to all associated matrix array elements in the sequential addressing cycles, which means that the large capacitance of the charging conductor does not have to be recharged when the next matrix array element is charged, thus yielding a significant reduction in power consumption. The voltage stored across the second capacitive device is used to control a switch between the first capacitive device and a potential source like ground in order to replace a predefined value stored in the first capacitive device with another predefined value of opposite sign, that is, replace a binary high with a binary low or vice versa, every two addressing cycles. This facilitates the reversal of the polarity of the first capacitive device at every addressing cycle, which is particularly useful if the first capacitive device includes a LC cell. This has the advantage that the use of dedicated power lines to power the device memorizing the state of the first capacitive device is avoided, thus reducing the complexity of the matrix array elements of the active matrix array device of the present invention. Optionally, the first, second and third switch may all be realized in the same technology, which allows for a reduction of the production cost of the active matrix array device of the present invention.

In an embodiment, each matrix array element further comprises a fourth switch coupled between the first capacitive device and the potential source, the fourth switch having a control terminal being responsive to a further enable signal. This has the advantage that the second capacitive device can be charged without immediately enabling the conductive path between the first capacitive device and the potential source. To this end, the fourth switch may be located in between the first capacitive device and the third switch, or between the third switch and the potential source.

Advantageously, the second capacitive device comprises a first sub-device and a second sub-device, the first sub-device having a first terminal coupled to the enable conductor and a second terminal coupled to a data terminal of the second switch, the second sub-device having a first terminal coupled to the data terminal of the second switch and a second terminal coupled to the further enable conductor. The distribution of the capacitive device over two sub-devices is useful in situations where the second capacitive device is connected to the conductors that are arranged to propagate the enable signal and the further enable signal, because the voltage waveforms used for the enable signal and the further enable signal can influence the voltage across the second capacitive device. These unwanted effects can be compensated for by using a distributed capacitive device.

It is another advantage if the potential source is provided via the associated charging conductor. The use of the charging conductor to couple the first capacitive device to the potential source obviates the need for a dedicated conductor, which simplifies the architecture of the active matrix array device.

It is yet another advantage if each matrix array element further comprises a fifth switch having a control terminal responsive to a read-enable signal, a first data terminal coupled between the third switch and the fourth switch, and a further data terminal coupled to a read-out conductor. Such an arrangement facilitates a read-out of the data stored in the first capacitive element.

In another embodiment, the second switch may be of a different channel type to the fourth switch, the control terminal of the second switch and the control terminal of the fourth switch being coupled to a common conductor. Although this adds to the production cost of the active matrix array device because of the fact that two types of switches have to be fabricated, it reduces the complexity of the active matrix array device, because a single conductor can be used to control both the second and the fourth switch.

According to a second aspect of the invention, there is provided an electronic device comprising an active matrix array device comprising a plurality of charging conductors, a plurality of addressing conductors crossing the plurality of charging conductors and a plurality of matrix array elements, each matrix array element comprising a first switch having a control terminal is coupled to an associated addressing conductor and a data terminal coupled to an associated charging conductor, each matrix array element further comprising a first capacitive device coupled to a further data terminal of the first switch, a second capacitive device coupled to the first capacitive device via a second switch having a control terminal responsive to an enable signal, the second capacitive device having a smaller capacitance than the first capacitive device and a third switch coupled between the first capacitive device and a potential source, the third switch having a control terminal coupled to the second capacitive device, the electronic device further comprising drive circuitry for driving a plurality of signals onto the plurality of addressing conductors, further drive circuitry for driving a plurality of further signals onto the plurality of addressing conductors and a power supply for powering the drive circuitry and the further drive circuitry. Such an electronic device benefits from an active matrix array device of the present invention because the power supply has to supply less power to the active matrix array device producing a constant output over a prolonged period of time. This is particularly advantageous when the power supply is a battery pack or a similar power supply, because such an electronic device, which may be a laptop, mobile phone, personal digital assistant and so on, can operate for a longer period without having to replace or recharge the power supply. This is an important advantage, because this operational period is an important marketing quality of such electronic devices.

According to a third aspect of the invention, there is provided a method of operating an active matrix array device having a plurality of matrix array elements including first and second capacitive devices, comprising storing a first voltage across the first capacitive device of a matrix array element, storing the first voltage across the second capacitive device of the matrix element, replacing the first voltage across the first capacitive device of the matrix array element with a second voltage, and depending on the magnitude of the first voltage stored across the second capacitive device, enabling a current path between the first capacitive device and a potential source for replacing the second voltage across the first capacitive device with a third voltage. This method provides for a simple way of maintaining the data stored in a matrix array element without having to permanently store the data in the matrix array element.

Figure 2:
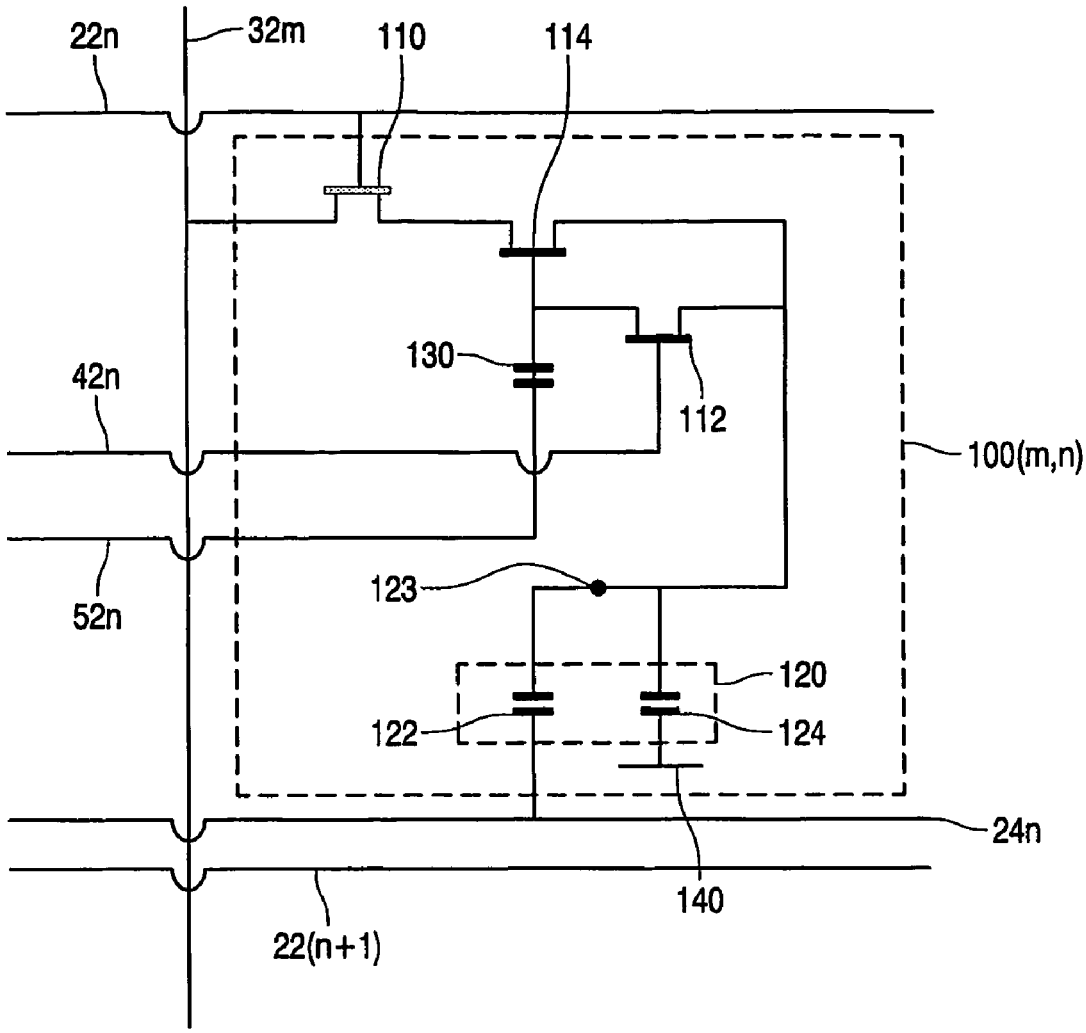
Figure 3:
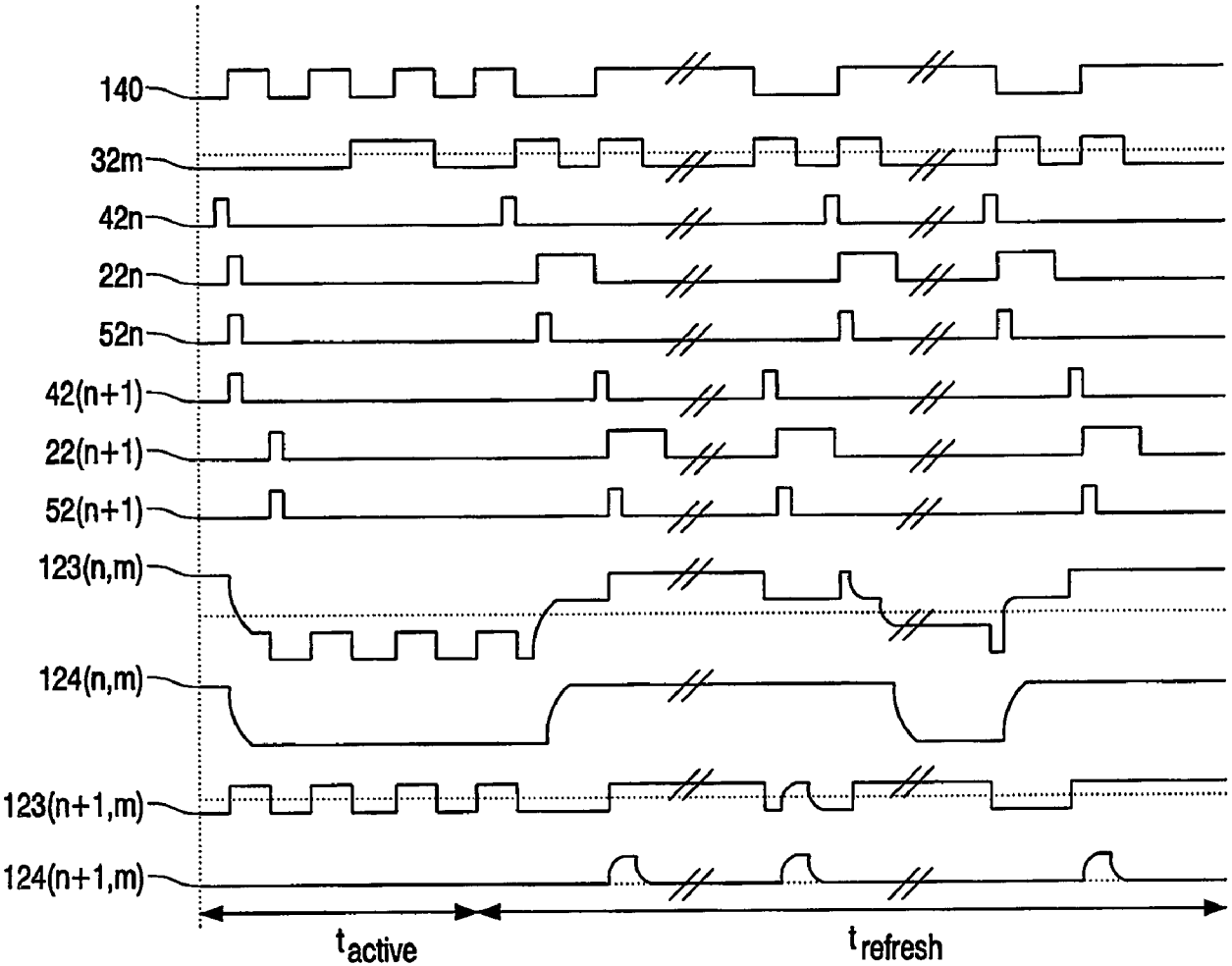
Figure 7:
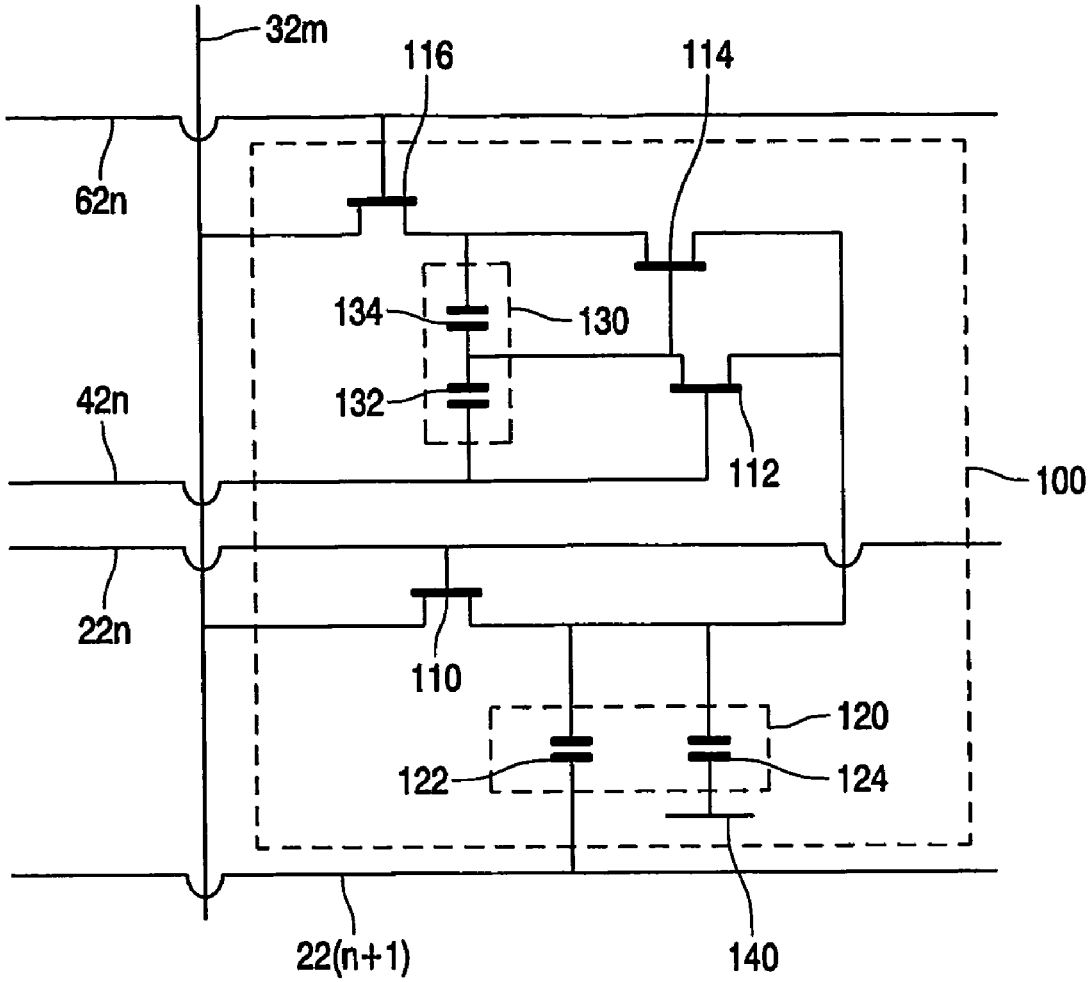
Figure 8:
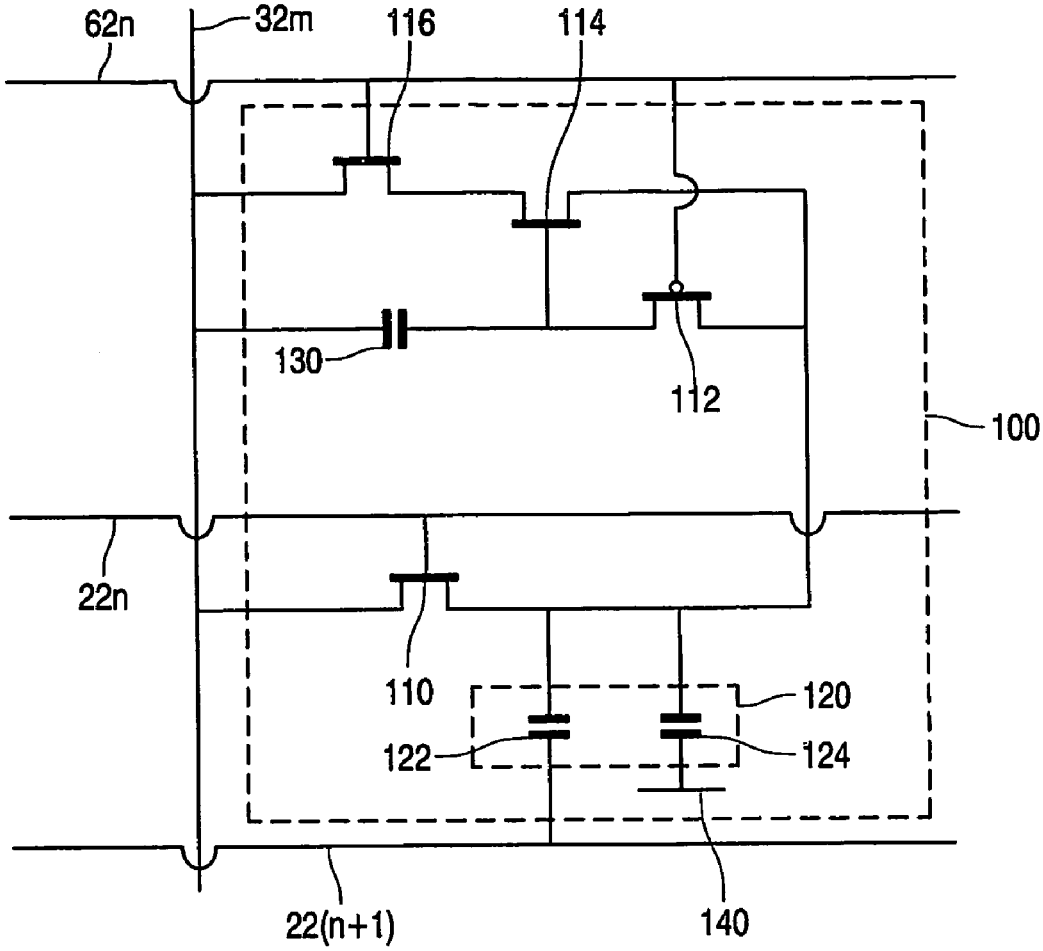
Figure 9:
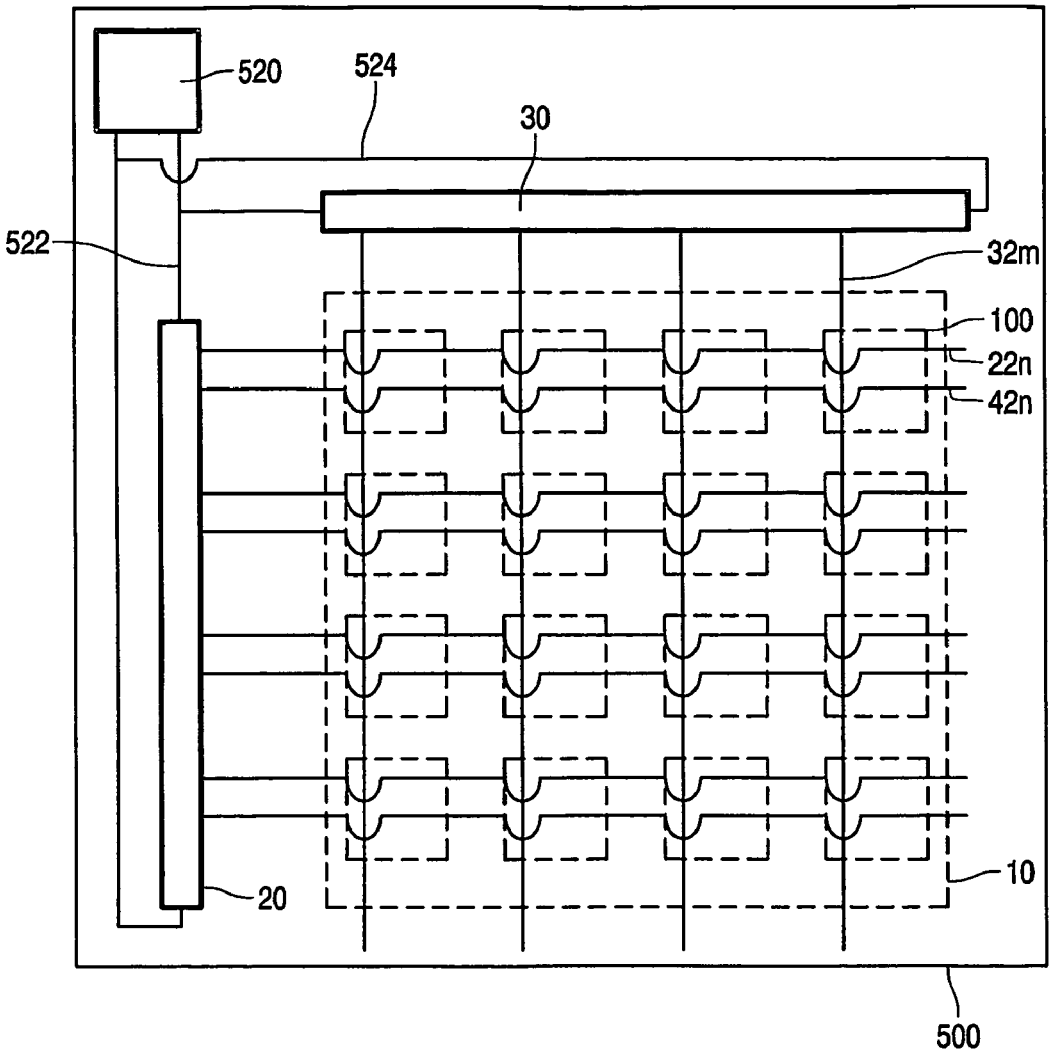

The invention is described in more detail and by way of non-limiting examples with reference to the accompanying drawings, wherein:

FIG. 1 schematically depicts the general structure of a known active matrix array device;

FIG. 2 schematically depicts an embodiment of an active matrix array device of the present invention;

FIG. 3 schematically depicts a plurality of voltage waveforms for operating an active matrix array device of the present invention;

FIGS. 4-8 schematically depict further alternative embodiments of an active matrix array device of the present invention; and FIG. 9 schematically depicts an electronic device of the present invention.

It should be understood that the Figures are merely schematic and are not drawn to scale. It should also be understood that the same reference numerals are used throughout the Figures to indicate the same or similar parts.

FIG. 1 schematically depicts a prior art active matrix array device 10. The active matrix array device 10 includes a plurality of addressing conductors 22, which are shown as row conductors coupled to driver circuitry 20, and a plurality of charging conductors 32 crossing the addressing conductors 22, and which are shown as column conductors coupled to further driver circuitry 30. The active matrix array device 10 further includes a plurality of matrix array elements 100, each of which has a first switch 110 with a control terminal coupled to one of the addressing conductors 22 and a data terminal coupled to one of the charging conductors 32. Typically, the first switch 110 may be a thin film transistor (TFT), with its gate being the control terminal and its source being the data terminal. The matrix array elements 100 further comprise a first capacitive device 120 coupled to a further data terminal of the first switch, for example, the drain terminal of a TFT. The capacitive device 120 may include a display element like a liquid crystal cell and an associated capacitor in case of the active matrix array device 10 being a display device.

In the case of active matrix array device 10 being a LC display device, it is typically operated in the following way. Driver circuitry 20 and further driver circuitry 30 are responsive to timing signals that are typically derived from a video signal source (not shown) by dedicated hardware (not shown). The driver circuitry 20 provides a selection signal on one of the addressing conductors 22 to enable the charging of the matrix array elements 100 that have the control terminals of the first switches 110 coupled to that addressing conductor 22. Further driver circuitry 30 provides a plurality of data voltage signals on the charging conductors 32 in order to store a plurality of charges in the first capacitive devices 120 of the selected matrix array elements 100. Typically, these charges correspond with gray-scale levels defined by the video signal. This process is repeated for the next addressing conductor 22 until all of the addressing conductors 22 have been addressed by the driver circuitry 20. The full cycle of addressing each addressing conductor 22 once is typically performed within the field or frame period of the video signal.

To avoid the ageing of the materials used in a display type first capacitive device 120 of a matrix array element 100, for instance a LC pixel, the polarity of the first capacitive device 120 can be alternated in successive field periods. Two commonly used techniques to do so are the field frequency inversion technique, in which all first capacitive devices 120 are of the same polarity, which is inverted after each field period, or a line frequency inversion technique, where the first capacitive devices 120 of the matrix array elements 100 on a given addressing conductor 22 are kept at an opposite polarity to the first capacitive devices 120 of the matrix array elements 100 on neighbouring addressing conductors 22, with the absolute sign of these polarities being inverted each field period.

The charging of the first capacitive devices 120 in the matrix array elements 100 via the charging conductors 32 typically accounts for a large part of the total power consumption of an active matrix array device 10. This, amongst other reasons, is caused by the fact that each of the charging conductors 32 has a large capacitance, which may be at least several picofarads, which has to be charged and discharged numerous times when charging the first capacitive devices 120 of the various matrix array elements 100 during a field or frame period. Therefore, a reduction of this particular part of the power consumption of an active matrix array device 10 can significantly contribute to the reduction of the overall power consumption by the active matrix array device 10, which can help extend the lifetime of a finite power supply like a battery. Such reductions in power consumption can for instance be achieved when there is no need to replace the charges stored in the first capacitive devices 120 with every field period, for instance because the predefined state like the brightness level of the matrix array element 100 has not changed, which for instance is the case when the active matrix array device 10 is expected to produce a constant output during a limited time period like a standby period of an electronic device including the active matrix array device 10.

In the following Figs, it will be assumed that the active matrix array device 10 comprises N addressing conductors 22 and M charging conductors 32, with N and M being positive integers. Where the letter n is used as a label to a reference numeral it denotes one of the N addressing conductors 22 or another conductor associated with a matrix array element 100 that is coupled to the addressing conductor 22*n*. In analogy, the label n+1 denotes the next addressing conductor 22 in the array, and the label m denotes one of the M charging conductors 32.

FIG. 2 shows a first embodiment of a part of an active matrix array device 10 according to the present invention. In this embodiment, each matrix array element 100 has a first switch 110 coupled between a charging conductor 32 and a first capacitive device 120. In FIG. 2, the first capacitive device 120 includes a first capacitive sub-device 122, which may be a storage capacitor, and a second capacitive sub-device 124, which may be a capacitive display element like a LC pixel, although it is emphasized that the first capacitive device 120 may be a single device or a more distributed device as well. By way of non-limiting example, the first capacitive sub-device 122 is coupled to a dedicated electrode 24*n*, which is typically shared by the sub-devices 122 of the matrix array elements 100 that share an addressing conductor 22*n*. Alternatively, the first capacitive sub-device 122 may also be coupled to the addressing conductor 22($n$+1) of the next row of matrix array elements 100. The second capacitive sub-device 124 is coupled to the common electrode 140. However, it is emphasized that other embodiments of first capacitive device 120, for instance as part of non-display type active matrix array devices 10, are equally feasible. Each matrix array element 100 further includes a second switch 112 coupled between the first capacitive device 120 and a second capacitive device 130, which may be a dedicated capacitor, a gate of a TFT used for capacitive purposes or any other known capacitive device. The second switch 112 has a control terminal coupled to an enable conductor 42*n*, whereas the second capacitive device 130 is further coupled to a further electrode 52*n*. Further electrode 52*n* may be a dedicated electrode or may be a conductor shared with another device within a matrix array element 100. Such a shared conductor may for instance be another electrode or an addressing conductor 22.

The matrix array element 100 comprises a third switch 114, which has a control terminal coupled to the second capacitive device 130, and which has its conductive path coupled between the first switch 110 and the first capacitive device 120. In operation, the matrix array elements 100 of the active matrix array device 10 are operated as explained by the following method.

In a first step, a first voltage is stored across the first capacitive device 120 of a matrix array element 100. This is typically done during an active mode of the active matrix array device 10, for instance the video signal processing mode of an active matrix array display device. To this end, the addressing conductor 22*n* is provided with an addressing pulse to switch on the first switch 110 to allow an appropriate first voltage to be stored across the first capacitive device 120 according to the data signal voltage applied to the charging conductor 32*m*. In the embodiment shown in FIG. 2, this means that third switch 114 has to be enabled simultaneously with first switch 110 because third switch 114 is placed in the conductive path between the first switch 110 and the first capacitive device 120. This can be achieved by providing the further electrode 52*n* with an appropriate voltage to enable the third switch 114 via further capacitive device 130 while keeping the second switch 112 switched off. However, it will be demonstrated by means of alternative embodiments that the third switch 114 can also be placed outside the conductive path between the first switch 110 and the first capacitive device 120, in which case the third switch 114 does not have to be enabled during the first step of the method for operating the active matrix array device 10.

In a next step, which may initiate a period in which the active matrix array device 10 is operated in a low-power mode like a standby mode, the first voltage is stored across the second capacitive device 130 of the matrix element 100. This is done by enabling the second switch 112 by providing the enable conductor 42*n* with an enable signal. Consequently, the second capacitive device 130 serves as a memory element for the first voltage stored across the first capacitive device 120.

In a third step, the first voltage across the first capacitive device 120 of the matrix array element 110 is replaced with a second voltage. This second voltage may be supplied to the first capacitive element 120 in the same way as the first voltage is supplied, that is, via the charging conductor 32*m*.

The method is completed by a fourth step, in which a current path between the first capacitive device 120 and a potential source is enabled depending on the magnitude of the first voltage stored across the second capacitive device 130. The potential source may be a dedicated electrode or may be provided via one of the charging conductors 32, such as associated charging conductor 32*m*. If the current path is enabled, the second voltage across the first capacitive device 120 is replaced with a third voltage.

This method provides for a refresh of the first voltage stored initially across the first capacitive device 120 of the matrix array element 100 with an inversion of the polarity of the first voltage in subsequent cycles of the operating method, thus enabling the preservation of materials like LC materials in the first capacitive devices 120.

FIG. 3 gives a non-limiting example of a set of time-dependent voltage waveforms that may be used to implement the earlier described operating method on an active matrix array device 10 as described in FIG. 2. In FIG. 2, a node 123 is included in the matrix array element 100 to allow the display of the voltage waveform at this point of the matrix array element 100. In the example, the most relevant voltage waveforms for a matrix array element 100 coupled to a charging conductor 32*m* and an addressing conductor 22*n*, as well as for a matrix array element 100 coupled to a charging conductor 32*m* and an addressing conductor 22(*n*+1). The node 123 and the capacitive sub-device 124 of the former matrix array element 100 are labelled (n,m), whereas the node 123 and the capacitive sub-device 124 of the latter matrix array element 100 are labelled (n+1,m).

FIG. 3 shows two main time periods; the period on the left hand side is labelled $t_{active}$ and is typically associated with an active mode of the active matrix array device like the video mode of a display device. The period on the right hand side is labelled $t_{refresh}$ and is typically associated with a passive or refresh mode of the active matrix array device like a standby mode of an electronic device including an active matrix display device, during which the active matrix display device has to generate a predominantly constant image.

It is assumed that the active matrix array device 10 is addressed using a line frequency inversion scheme in which alternate rows of matrix array elements 100 receive drive voltages of opposite polarity and it is also assumed that a common electrode 140 drive scheme is used in which part of the alternating drive voltage required by the second capacitive sub-device 124 is applied to the common electrode of the active matrix array device 10 resulting in a reduction in the amplitude of the charging conductor 32 drive voltage. These waveforms illustrate the principle of operation of the self-refreshing matrix array elements 100 but they are not unique and have not been optimised.

The waveforms illustrate the addressing of two matrix array elements 100, a first matrix array element 100 coupled to charging conductor 32*m* and addressing conductor 22*n* and a second matrix array element 100 coupled to charging conductor 32*m* and addressing conductor 22(*n*+1). In the active mode the active matrix array device 10 is addressed in the conventional way, for instance with video information being applied to the charging conductors 32 of the active matrix array device 10 being a display device, followed by a group of pixels being addressed by taking the associated addressing conductor 22 to a high voltage level.

The waveforms at the bottom of FIG. 3 labelled 124(*n,m*), 123(*n,m*), 124(*n*+1,*m*) and 123(*n*+1,*m*) show the voltages across the capacitive sub-devices 124 and on the nodes 123 of the two chosen matrix array elements 100. The matrix array element 100 that is coupled to addressing conductor 22*n*, is addressed with a high rms voltage which would normally result in the matrix array element appearing dark in the case of this active matrix array element 100 being part of a matrix array display device. The matrix array element 100 that is coupled to addressing conductor 22(*n*+1), is addressed with a low rms voltage which would normally result in the matrix array element appearing light in the case of this active matrix array element 100 being part of a matrix array display device.

When the active matrix array device 10 is switched over to a self refreshing mode it is no longer necessary to supply the matrix array elements 100 with information from the drive circuitry 30 as the data is refreshed within the matrix array elements 100. This refresh operation could be carried out sequentially, addressing conductor by addressing conductor, in the same way that the matrix array elements 100 are normally addressed sequentially in the active mode. However, there is an advantage to refreshing the active matrix array elements 100 in a different way, for example by simultaneously addressing all matrix array elements 100 that have the same drive polarity, as this can reduce the frequency of the drive waveforms applied to the common electrode 140 of the active matrix array device 10 and therefore the power consumption of the active matrix array device 10. One option is to refresh all of the matrix array elements 100 coupled to odd numbered addressing conductors 22 simultaneously and then to refresh all of the matrix array elements 100 coupled to even numbered addressing conductors 22 simultaneously. This is the situation illustrated in FIG. 3.

When the active matrix array device 10 enters the self-refreshing mode the matrix array elements 100 coupled to the even numbered addressing conductors 22*n* are refreshed first. This is started by setting the voltage on the common electrode 140 of the active matrix array device 10 to the same level as when the even numbered addressing conductors 22*n* were last addressed in active mode, for instance during the last field period of the video mode of a display device. The voltage across the associated capacitive sub-devices 122 and 124 will then lie within the range established by the drive circuitry 30. The enable conductors 42*n* of the matrix array elements coupled to the even numbered addressing conductors 22*n* are taken to a high level during a sense period in order to enable second switches 112 and sense the first voltage on the capacitive devices 120. The voltage on the common electrode 140 of the active matrix array device 10 is then switched to its second level and a high data voltage level is applied to the charging conductors 32. The even numbered addressing conductors 22*n* as well as the further electrodes 52*n* are taken to a high level during an overwrite period to enable the first switches 110 and the third switches 114 and allow for the high data voltage level, that is, the second voltage, to be stored across the first capacitive devices 120 of the associated matrix array elements 100.

Next, the voltage on the charging conductors 32 and the further electrodes 52*n* is returned to a low voltage level, with the even numbered addressing conductors 22*n* kept at a high voltage level during an update period. If a high data voltage level was present on a first capacitive device 120 during the sense period then this voltage level will have been copied onto the associated second capacitive device 130, thus keeping the third switch 114 of the associated matrix array element 100 enabled. This provides a conductive path between the first capacitive device 120 and the associated charging conductor 32, which provides a potential source, that is, ground, for the first capacitive devices 120. Consequently, the first capacitive devices 120 are discharged to adopt a third voltage, which in this case is a low data voltage level. If a low data voltage level would have been present on a first capacitive device 120 during the sense period then the associated third switch 114 would remain disabled, and the voltage across the first capacitive device 120 would remain at the second voltage, that is, the high data voltage level.

Next, the matrix array elements 100 coupled to the odd numbered addressing conductors 22($n$+1) are refreshed. The common electrode 140 voltage is already at the correct level, the level present when the matrix array elements 100 were addressed during the active cycle, and the enable conductors 42($n$+1) of the matrix array elements 100 coupled to the odd numbered addressing conductors 22($n$+1) can be taken to a high voltage level during a sense period in order to sense the voltage across the first capacitive devices 120. The voltage on the common electrode 140 is then switched and the high data voltage level is applied to the charging conductors 32. The addressing conductors 22($n$+1) of the associated matrix array elements 100 are then taken to a high level during an overwrite period and the first capacitive devices 120 in those matrix array elements 100 are precharged to the high data voltage level. The voltage on the charging conductors 32 as well as on the further electrodes 52($n$+1) is then returned to the low data voltage level with the addressing conductors 22($n$+1) kept at a high voltage level during an update period. Again, this refreshes the voltage across the first capacitive devices 120 governed by the voltage across the second capacitive devices 130 as previously explained.

The voltages on the addressing conductors 22 are now held constant until the matrix array elements 100 are refreshed again. The period that can be allowed before the matrix array elements 100 are refreshed again depends on the rate at which the voltage on the first capacitive device 120 capacitance discharges due to leakage currents, like the leakage current through the switches of the matrix array elements 100 or through the second capacitive sub-device 124. When the matrix array elements 100 are refreshed for the second time the sequence of refreshing the matrix array elements 100 coupled to odd and even addressing conductors 22 is reversed. This reduces the number of transition in the common electrode 140 drive voltage waveform.

It is emphasized that the second capacitive device 130 preferably should have a significantly smaller capacitance than the first capacitive device 120 to prevent the charge transfer from the first capacitive device 120 to the second capacitive device 130 having a significant effect on the voltage across the first capacitive device 120.

Also, it will be appreciated by those skilled in the art that this arrangement for refreshing the state of a matrix array element 100 is particularly suitable for active matrix array devices 10 having matrix array elements 100 that can be configured to two states, for instance, an on state defined by a high voltage across the first capacitive device 120 of the matrix array element 100 and an off state defined by a low voltage across the first capacitive device 120 of the matrix array element 100. Rather than having to individually restore all individual voltages via the charging conductors 32, which is usually accompanied by large power consumptions as previously explained, the charging conductors 32 can be provided with a single voltage during the refresh cycles of the active matrix array device 10 of the present invention if the charging conductors 32 do not have to serve as a connection between a capacitive device 120 and the potential source. If the charging conductors 32 do serve as such a connection, the charging conductors 32 have to be supplied with two voltages during the refresh cycles of the active matrix array device 10 of the present invention. Consequently, the capacitances associated with the charging conductors 32 only have to be charged once or twice, which leads to a significant reduction in power consumption for the active matrix array device 10 of the present invention compared to active matrix array devices that lack refresh circuitry in the matrix array elements 100.

It will also be understood that instead of providing the various first capacitive devices 120 with a high second voltage and subsequently coupling the first capacitive devices 120 to a low voltage potential source like ground, the first capacitive devices 120 may also be provided with a low voltage second voltage after which the first capacitive devices 120 are coupled to a high voltage potential source like a supply voltage source without departing from the teachings of the present invention.

Figure 4:
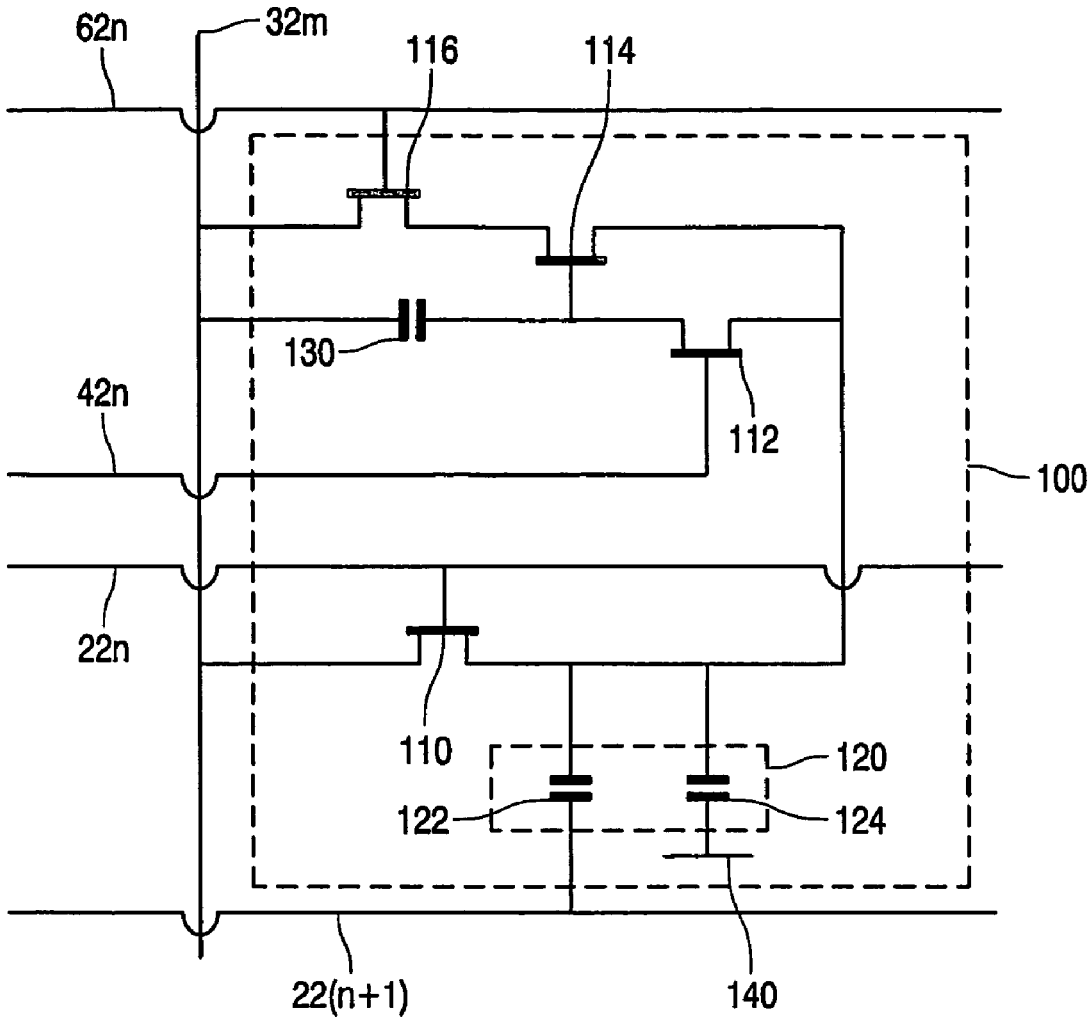

FIG. 4 shows another embodiment of a part of the active matrix array device 10 according to the present invention. Compared to the embodiment shown in FIG. 2, this embodiment includes a fourth switch 116, which has a control terminal coupled to a further enable conductor 62*n*, and is coupled between the third switch 114 and the charging conductor 32*m*. In this arrangement, the second capacitive element 130 is coupled between the second switch 112 and the charging conductor 32*m*, which has the advantage that no additional electrode is required to define the voltage across the second capacitive device 130. In addition, the first switch 110 is no longer present in the conductive path between the first capacitive device 120 and the potential source provided via the charging conductor 32*m*, the third switch 114 and the fourth switch 116. This has the advantage that the second capacitive device 130 does not have to be involved in the charging of the first capacitive device 120 in the active mode of the active matrix array device 10, in contrast to the embodiment shown in FIG. 2. In refresh mode, the fourth switch 116 is provided with a further enable signal after the voltage across the first capacitive device 120 has been sampled, or sensed, by the second capacitive device 130. Simultaneously, the charging conductor 32*m* is provided with the third voltage, which will replace the second voltage stored across the first capacitive device 120 if the third switch 114 is enabled by the charge stored on the second capacitive device 130.

Figure 5:
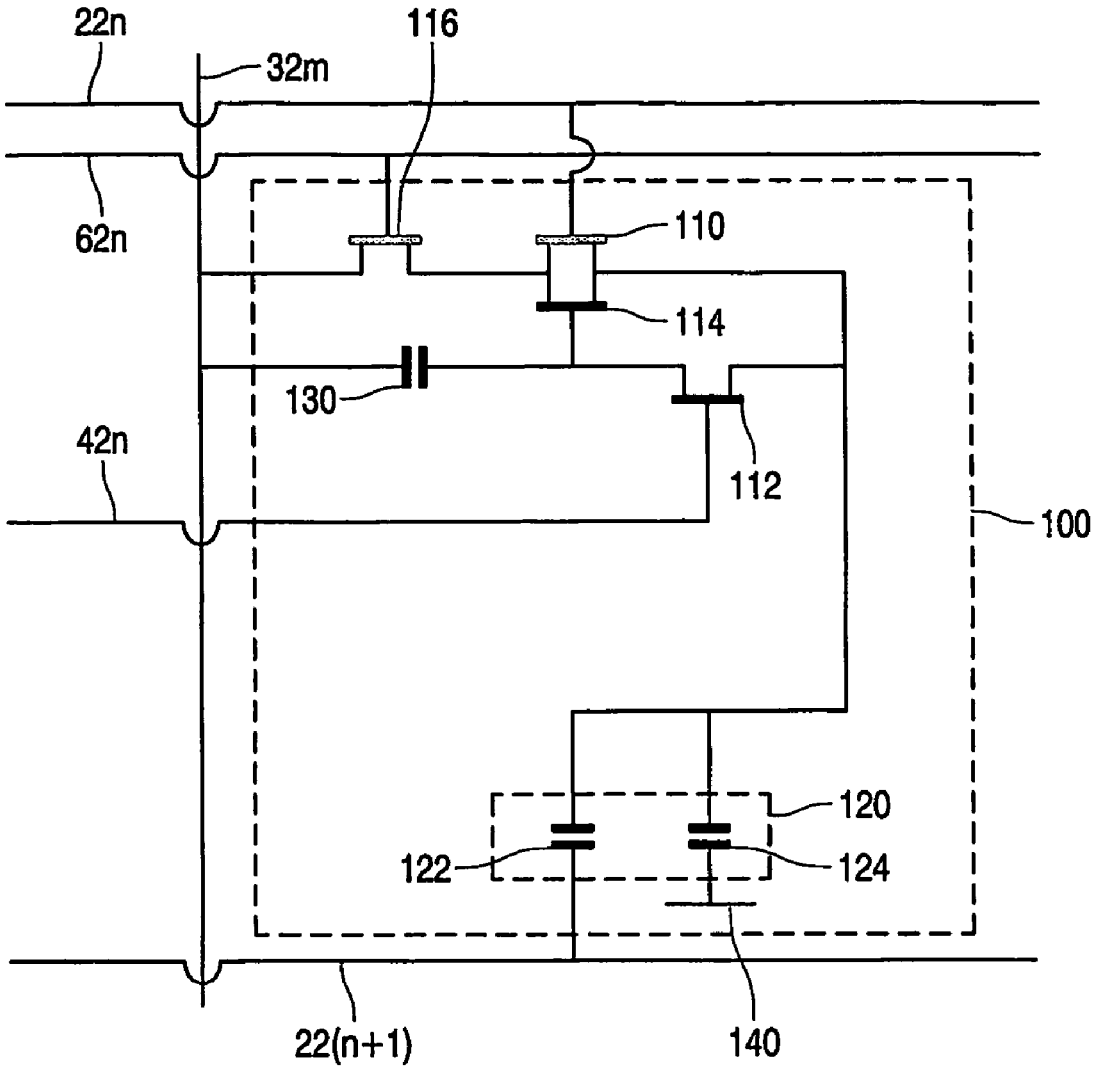

FIG. 5 shows an alternative arrangement of the circuit shown in FIG. 4, wherein the first switch 110 is arranged in parallel with the third switch 114. Consequently, the charging conductor 32*m* is directly connected to only a single switch, that is, fourth switch 116, rather than the direct connection to the first switch 110 and the fourth switch 116 of the embodiment shown in FIG. 4. Since each switch directly connected to a charging conductor 32 adds to the capacitance of the charging conductor 32 and increases the number of leakage current paths from the charging conductor 32, the matrix array element 100 of the active matrix array device 10 shown in FIG. 5 has improved characteristics compared to the embodiment shown in FIG. 4. This is particularly relevant during the active mode of the active matrix array device 10, where, amongst others, it is important that the drive voltage from the drive circuitry 30 stays constant during the addressing period of the matrix array element 100.

Figure 6:
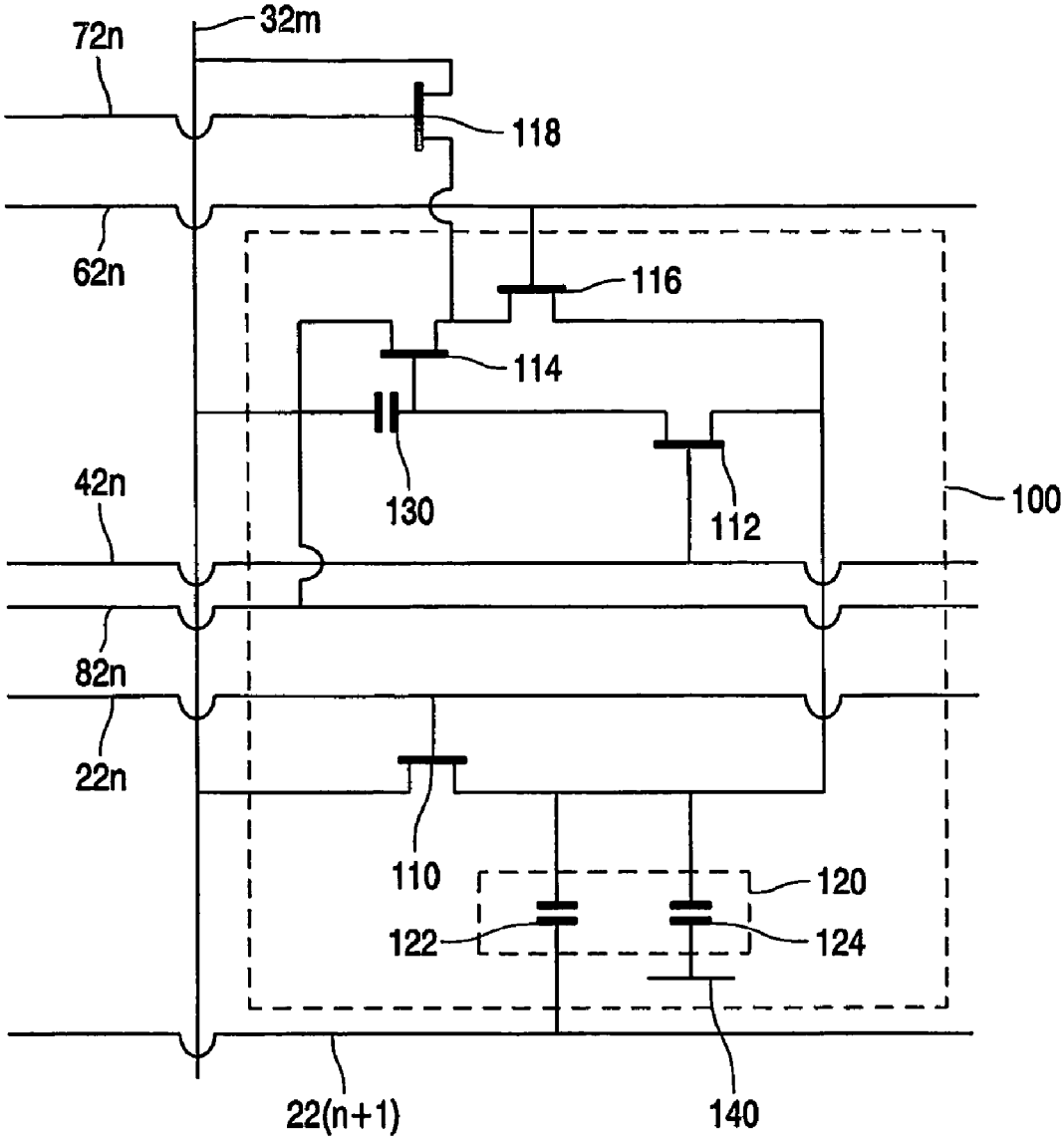

FIG. 6 shows a part of an active matrix array device 10 that provides a readout function to the matrix array element 100 during refresh mode. To this end, the first switch 110 is coupled to a separate potential source 82*n*, which may be enabled during the refresh mode of the active matrix array device 10 in the previously described way. The fourth switch 116 is located in the conductive path between the first switch 110 and the third switch 114, with a fifth switch 118 having a data terminal like its source coupled to the conductive path between the fourth switch 116 and the third switch 114. The fifth switch 118 has a further data terminal like its drain coupled to the charging conductor 32*m*, and a control terminal coupled to a read enable conductor 72*n*. The second capacitive device has, by way of non-limiting example, a terminal coupled to the potential source 82*n*, although alternative arrangements are equally feasible.

The matrix array element 100 can be read out by charging the charging conductor 32*m* and enabling the fifth switch 118. If a voltage drop is observed, which may be monitored by the drive circuitry 30, this indicates the presence of a conductive path between the charging conductor 32*m* and the potential source 82*n*, which implies that the second capacitive device 130 holds a high voltage, because the third switch 116 is enabled. Since the second capacitive device 130 holds a copy of the data stored in the first capacitive device 120, the data value stored in the first capacitive device 120 is known too.

At this point, it is emphasized that the circuits shown in FIGS. 4 and 5 can similarly be extended with a fifth switch 118 (not shown in these Figs.). However, the readout of the matrix array element 100 then has to take place during the coupling of the first capacitive device 120 to the potential source provided via the charging conductor 22, with the further data terminal of the fifth switch coupled to a separate conductor. If a current flow is detected via the fifth switch 118, this is an indication of the third switch 114 being enabled. However, the problem with this arrangement is that parasitic currents flowing from the charging conductor 32*m* through the fifth switch 118 via the fourth switch 116 can give rise to faulty interpretations of the readout signal, which is why the embodiment shown in FIG. 6 is preferred, because this read-out can be done while the matrix array element 100 is in a quiescent state, thus avoiding the risk of corrupting the readout signal.

FIG. 7 shows another embodiment of a part of the active matrix array device 10 according to the present invention, in which the second capacitive device 130 uses the further enable conductor 62*n* and the enable conductor 42*n* as electrodes. As has been emphasized before, many alternative connection schemes for the second capacitive device 130 are available, with this particular arrangement being one of them. However, when having the second capacitive device 130 coupled between the further enable conductor 62*n* and the enable conductor 42*n*, care has to be taken that the appropriate voltage stored across the second capacitive device 130 is not disturbed by the waveforms carried by these conductors, which could corrupt the proper enabling of the third switch 114, thus jeopardizing the correctness of the data being stored in the first capacitive device 120. For instance, if the second switch 112 is an n-channel type device, the transition of the enable conductor 42*n* from a high voltage to a low voltage at the end of the sense period of the first capacitive device 120 by the second capacitive device 130 causes the voltage at the control terminal of the third switch 114 to be lower than that sampled from the first capacitive device 120, which may prevent the third switch 114 from being switched on properly. Also, if the voltage on the further enable electrode 62*n* switches from a low to a high voltage level, the control terminal of the third switch 114 tends to experience a voltage higher than that sampled from the first capacitive device 120, which may erroneously switch on the third switch 114.

To compensate for such disturbances, the second capacitive device 130 comprises a first sub-device 132 and a second sub-device 134, the first sub-device 132 having a first terminal coupled to the enable conductor 42*n* and a second terminal coupled to a data terminal, for instance the drain, of the second switch 112, the second sub-device 134 having a first terminal coupled to the data terminal of the second switch 112 and a second terminal coupled to the further enable conductor 62*n*. The terminals of the sub-devices 132 and 134 may be plates of respective capacitors. By distributing the second capacitive device 130 over the first sub-device 132 and the second sub-device 134, the coupling effects with the further enable conductor 62*n* and the enable conductor 42*n* are largely cancelled out, providing a stable enough voltage across the second capacitive device 130.

Alternatively, in situations where the second switch 112 has a large enough capacitance, the first sub-device 132 may be omitted, with the capacitance of the second switch 112 providing the desired distributed capacitance to compensate for the disruptive effects of the voltage waveforms on the enable conductor 42*n*.

At this point, it is emphasized that the embodiments of the active matrix array device 10 of the present invention described so far all have the advantage that the switches used in the matrix array elements 100 may be realized in the same technology, for instance by means of n-channel type or p-channel type TFTs or other known switching elements. This reduces the complexity of the fabrication process of the active matrix array device 10, thus leading to a lower production cost and higher yield of such devices. However, the active matrix array device 10 of the present invention may also benefit from using switches of opposite channel type. This is shown in the embodiment of FIG. 8, where the second switch 112 is a p-channel type device and the fourth switch 116 is an n-channel type device. This has the advantage that only a single enable conductor, that is, enable conductor 62*n*, is required to address both second switch 112 and fourth switch 116, because the second switch 112 typically should be switched off when the fourth switch is switched on and vice versa, which is guaranteed by the fact that both switches are of opposite channel type and responsive to the same voltage waveform. The layout of the matrix array elements 100 benefit from the fact that only a single additional conductor is required, which is particularly relevant when the active matrix array device 10 is a display device, where the reduction in the complexity of a matrix array element 100 typically leads to improved display characteristics.

FIG. 9 shows an electronic device 500 having an active matrix array device 10 of the present invention. The internals of the matrix array elements 100 are omitted for reasons of clarity only. The active matrix array device 10 includes a plurality of enable conductors 42 by way of non-limiting example; other additional sets of conductors that are necessary to implement the embodiments disclosed in the previous Figs. may also be present. Typically, but not necessarily, the active matrix array device 10 is a display device, with the electronic device 500 being a monitor, television, laptop computer, personal digital assistant, mobile phone or a similar type device.

The electronic device 500 has a power supply 520 for powering the driver circuitry 20 via line 522 and the further driver circuitry 30 via line 524. The driver circuitry 20 and the further driver circuitry 30 may be an integral part of the active matrix array device 10 or may be realized in a different technology than that of the active matrix array device 10. The electronic device 500 benefits from the presence of the active matrix array device 10 of the present invention because the power consumption of the driver circuitry 20 and the further driver circuitry 30 can be greatly reduced, for instance when the electronic device 500 is switched to a standby mode with the active matrix array device 10 going into the previously described refresh mode. This is particularly advantageous to battery-powered electronic devices 500, because such devices regularly switch to some form of a standby mode in order to prolong the lifetime of the battery. In fact, the battery lifetime is an important marketing quality of such electronic devices, and the inclusion of an active matrix array device 10 according to the present invention increases the marketability of the electronic device 500 for that reason.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. An active matrix array device comprising:

a plurality of charging conductors;

a plurality of addressing conductors crossing the plurality of charging conductors; and a plurality of matrix array elements, each matrix array element comprising a first switch having a control terminal coupled to an associated addressing conductor and a first data terminal coupled to an associated charging conductor, each matrix array element further comprising:

a first capacitive device coupled to a second data terminal of the first switch;

a second capacitive device coupled to the first capacitive device via a second switch having a control terminal responsive to a first enable signal, the second capacitive device having a smaller capacitance than the first capacitive device;

a third switch coupled between the first capacitive device and a potential source, the third switch having a control terminal coupled to the second capacitive device; and a fourth switch coupled between the first capacitive device and the potential source, the fourth switch having a control terminal being responsive to a second enable signal.

2. An active matrix array device as claimed in claim 1, wherein the third switch is coupled between the first capacitive device and the fourth switch.

3. An active matrix array device as claimed in claim 1 wherein the fourth switch is coupled between the first capacitive device and the third switch.

4. An active matrix array device, comprising:

a plurality of charging conductors;

a plurality of addressing conductors crossing the plurality of charging conductors; and a plurality of matrix array elements, each matrix array element comprising a first switch having a control terminal coupled to an associated addressing conductor and a first data terminal coupled to an associated charging conductor, each matrix array element further comprising:

a first capacitive device coupled to a second data terminal of the first switch;

a second capacitive device coupled to the first capacitive device via a second switch having a control terminal responsive to a first enable signal, the second capacitive device having a smaller capacitance than the first capacitive device; and a third switch coupled between the first capacitive device and a potential source, the third switch having a control terminal coupled to the second capacitive device, wherein the second capacitive device comprises a first sub-device and a second sub- device, the first sub-device having a first terminal coupled to a first enable conductor for providing the first enable signal and a second terminal coupled to a data terminal of the second switch, the second sub-device having a first terminal coupled to the data terminal of the second switch and a second terminal coupled to a second enable conductor for providing a second enable signal, and wherein the third switch is coupled between the first capacitive device and the fourth switch.

5. An active matrix array device as claimed in claim 1, wherein the potential source is provided via the associated charging conductor.

6. An active matrix array device as claimed in claim 1, wherein each matrix array element further comprises a fifth switch having:

a control terminal responsive to a read-enable signal;

a first data terminal coupled between the third switch and the fourth switch; and a further data terminal coupled to a read-out conductor.

7. An active matrix array device as claimed in claim 3, wherein the second switch is of a different channel type than the fourth switch, the control terminal of the second switch and the control terminal of the fourth switch being coupled to a common conductor.

8. An electronic device comprising:

an active matrix array device comprising:

a plurality of charging conductors;

a plurality of addressing conductors crossing the plurality of charging conductors; and a plurality of matrix array elements, each matrix array element comprising a first switch having a control terminal coupled to an associated addressing conductor and a first data terminal coupled to an associated charging conductor, each matrix array element further comprising:

a first capacitive device coupled to a second data terminal of the first switch;

a second capacitive device coupled to the first capacitive device via a second switch having a control terminal responsive to an enable signal, the second capacitive device having a smaller capacitance than the first capacitive device;

a third switch coupled between the first capacitive device and a potential source, the third switch having a control terminal coupled to the second capacitive device; and a fourth switch coupled between the first capacitive device and the potential source, the fourth switch having a control terminal being responsive to a second enable signal;

the electronic device further comprising:

a first drive circuitry for driving a plurality of first signals onto the plurality of addressing conductors;

a second drive circuitry for driving a plurality of second signals onto the plurality of addressing conductors; and a power supply for powering the first drive circuitry and the second drive circuitry.

9. A method of operating an active matrix array device having a plurality of matrix array elements including first and second capacitive devices, comprising:

storing a first voltage across the first capacitive device of a matrix array element;

storing the first voltage across the second capacitive device of the matrix element;

replacing the first voltage across the first capacitive device of the matrix array element with a second voltage; and depending on the magnitude of the first voltage stored across the second capacitive device, enabling a current path between the first capacitive device and a potential source for replacing the second voltage across the first capacitive device with a third voltage.

10. An active matrix array device as claimed in claim 1, wherein the control terminal of the third switch is a gate of a transistor.

11. An electronic device as claimed in claim 8, wherein the control terminal of the third switch is a gate of a transistor.

* * * * *